US012723759B2

(12) United States Patent
Parsania

(10) Patent No.: US 12,723,759 B2
(45) Date of Patent: Sep. 1, 2026

(54) COMBUSTOR FOR A GAS TURBINE

(71) Applicant: Siemens Energy Global GmbH & Co. KG, Munich (DE)

(72) Inventor: Nishant Govindbhai Parsania, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 548 days.

(21) Appl. No.: 18/550,305

(22) PCT Filed: Mar. 31, 2022

(86) PCT No.: PCT/EP2022/058581
§ 371 (c)(1),
(2) Date: Sep. 13, 2023

(87) PCT Pub. No.: WO2022/214384
PCT Pub. Date: Oct. 13, 2022

(65) Prior Publication Data

US 2026/0153236 A1 Jun. 4, 2026

(30) Foreign Application Priority Data

Apr. 6, 2021 (GB) ..... 2104885

(51) Int. Cl.
*F23R 3/14* (2006.01)
*F23R 3/28* (2006.01)
*F23R 3/34* (2006.01)

(52) U.S. Cl.
CPC ..... *F23R 3/14* (2013.01); *F23R 3/28* (2013.01); *F23R 3/343* (2013.01)

(58) Field of Classification Search
CPC .... F23R 3/14; F23R 3/28; F23R 3/286; F23R 3/343; F23D 14/62
See application file for complete search history.

(56) References Cited

U.S. PATENT DOCUMENTS

| | | | | |
|---|---|---|---|---|
| 4,455,840 | A * | 6/1984 | Matt | F23R 3/36 60/737 |
| 8,042,339 | B2 | 10/2011 | Lacy et al. | |
| 11,525,578 | B2 * | 12/2022 | Natarajan | F23R 3/46 |
| 2004/0055306 | A1 | 3/2004 | North et al. | |
| 2010/0218501 | A1 | 9/2010 | York et al. | |
| 2011/0057056 | A1 | 3/2011 | Ziminsky et al. | |
| 2012/0180487 | A1 * | 7/2012 | Uhm | F23R 3/286 60/737 |

(Continued)

OTHER PUBLICATIONS

PCT International Search Report and Written Opinion of International Searching Authority mailed Aug. 17, 2022 corresponding to PCT International Application No. PCT/EP2022/058581 filed Mar. 31, 2022.

*Primary Examiner* — Andrew H Nguyen

(57) ABSTRACT

A combustor (100) for a gas turbine comprising a combustion chamber (102) having an inlet (104). The combustion chamber inlet (104) is defined by a burner (30). The burner comprises a pilot burner section (200) centred on the centre axis (Y); a swirler section (300) comprising vanes (302) which extend radially outwards from the pilot burner section (200); and a main burner section (400) which extends radially outwards from, and surrounds, the swirler section (300).

14 Claims, 6 Drawing Sheets

(56) References Cited

U.S. PATENT DOCUMENTS

| | | | | |
|---|---|---|---|---|
| 2013/0074510 | A1* | 3/2013 | Berry | F23R 3/286 60/734 |
| 2013/0213051 | A1* | 8/2013 | Westmoreland, III | F23R 3/286 60/776 |
| 2013/0241089 | A1 | 9/2013 | Westmoreland et al. | |
| 2013/0327046 | A1 | 12/2013 | Bobba et al. | |
| 2017/0138267 | A1 | 5/2017 | Hughes et al. | |

* cited by examiner

COMBUSTOR FOR A GAS TURBINE

The present disclosure relates to a combustor for a gas turbine and to a method for operating a combustor for a gas turbine.

BACKGROUND

In such a technical field, it is a typical aim to reduce the emissions, in particular the high emissions of nitrogen oxides (NOx) caused by the high temperatures inside a combustion chamber. In particular, inside the combustor, the mixing of fuel and gas (air) is considered as the critical issue in avoiding areas with higher temperature and thereby in reducing overall NOx emissions.

Generally, a combustor comprises a main combustion chamber and a pre-combustion chamber upstream of the main combustion chamber. The pre-combustion chamber comprises a swirler section having a swirler through which air and fuel may be provided.

A pilot fuel is further injected typically by a pilot burner, generally in a direction parallel to the centre axis of the combustor. The pilot fuel is used for controlling the combustor flame in which the main fuel is burned.

Hydrogen is becoming increasingly popular as a fuel in a gas turbine to generate power. Most gas turbine systems which can burn a high percentage of hydrogen are diffusion based. Due to minimal or no pre-mixing, the fuel after injection burns at a higher equivalence ratio with very high localized temperature, leading to high NOx emissions.

Most of the current combustion systems which employ natural gas use dry low emission (DLE) technology, where fuel and air pre-mixes to reduce NOx emissions.

It is desirable to have a system which can be fuelled with hydrogen, natural gas or a blend of the two. However it is challenging to build a system which operates on both natural gas and hydrogen, which is operable to generate low NOx emissions and minimizes risk of combustion occurring in a pre-mix zone ("flashback").

SUMMARY

It may be an objective of the present disclosure to provide a combustion chamber providing low emissions of nitrogen oxides (NOx).

It may be a further objective of the present disclosure to provide a combustion chamber with a desired fuel distribution in the mixture of the gas inside the combustion chamber.

It may be another objective of the present disclosure to provide a combustion chamber with a desired flame profile.

This object is solved by a combustor for a gas turbine according to the independent claims. The dependent claims describe advantageous developments and modifications of the disclosure.

According to the present disclosure there is provided an apparatus as set forth in the appended claims. Other features of the disclosure will be apparent from the dependent claims, and the description which follows.

Accordingly there may be provided a combustor (100) for a gas turbine, the combustor (100) extending along a centre axis (Y) and comprising a combustion chamber (102) having an inlet (104). A burner (30) is provided in, is provided as and/or defines the inlet (104). The combustion chamber inlet (104) (i.e. the burner 30) may comprise a pilot burner section (200) centred on the centre axis (Y) and which defines a fuel delivery conduit (202) having an inlet (204) for fluid communication with a fuel source.

The pilot burner section (200) may further comprise a fuel injector (206) in fluid communication with the fuel delivery conduit (202). The burner (30) may further comprise a swirler section (300) comprising vanes (302) which extend radially outwards from the pilot burner section (200), and a main burner section (400) which extends radially outwards from, and surrounds, the swirler section (300).

The pilot burner section (200) is spaced apart from the main burner section (400) to define an annular swirl flow path (320) extending therebetween, the annular swirl flow path (320) comprises an upstream plane (722) and an exit plane (726).

The main burner section (400) may define a plurality of pre-mixing flow passages (402) which each extend from a pre-mixing flow passage inlet (404) on an inlet face (406) of the main burner section (400) to a pre-mixing flow passage outlet (408) on an outlet face (410) of the main burner section (400).

The main burner section (400) may further comprise a fuel manifold (412), each of the pre-mixing flow passages (402) being provided with a fuel injector (414) in flow communication with the fuel manifold (412). The fuel manifold (412) may be in communication with the fuel delivery conduit (202) in the pilot burner section (200) via a fuel flow passage (304) which extends through the swirler section (300).

The annular swirl flow path (320) may be divergent between the upstream plane (722) and the exit plane (726) and in the direction from the upstream plane (722) towards the exit plane (726).

The annular swirl flow path (320) may have a mid-path line (728), at the exit plane (722) the mid-path line (728) may have an angle θ to the centre axis Y of the combustor (100). The angle θ may be ≥5° and ≤45°, preferably the angle θ may be between ≥10° and ≤25°.

The combustor (100) may comprise an outlet face (410), the outlet face (410) faces downstream or towards the combustion chamber (102). The outlet face (410) comprises a central area (730) defined as the radially inward area of the outlet face (410) from the mid-path line (728) at the exit plane (722). The central area (730) has a radius R1 and the outlet face (410) has a radius R2. The radius R1 may be between and including and including 25% and 75% of R2, preferably R1 may be between and including 40% and 50% of R2 and preferably R1 may be 50% of radius R2.

A cross-sectional area of the exit plane (726) may be the same as or smaller than a cross-sectional area of the upstream plane (722) of the annular swirl flow path (320).

Preferably the cross-sectional area of the exit plane (726) is up to and including 10% less than the cross-sectional area of the upstream plane (722).

Each vane (302) may have a leading edge (303) and a trailing edge (306). A downstream direction (Y1) may be defined by the direction from the vane leading edge (303) to the vane trailing edge (306) along the centre axis (Y). An upstream direction (Y2) may be defined by the direction from the vane trailing edge (306) to the vane leading edge (303) along the centre axis (Y).

The vanes (302) may be spaced apart from one another around the outer circumference of the pilot burner section (200) to define oxidant flow passages (308), each oxidant flow passages (308) having a flow inlet (310) at the vane leading edge (303) and a flow outlet (312) at the vane trailing edge (306).

The pilot burner section (200) may extend axially away from the vane leading edge (303) in the upstream direction (Y2) and extend axially away from the vane trailing edge (306) in the downstream direction (Y1).

The pilot burner section (200) fuel injector (206) is located downstream of the vane trailing edge (306).

The combustion chamber 102 may be defined upstream by the outlet face 410 such that fuel/air injection is directly into the 'main' combustion chamber 102. For example, the main burner section 400 outlet face 410 defines (i.e. provides) at least part of the limit/boundary of the combustion zone of the combustion chamber 102. With this arrangement, combustion does not occur upstream of the main burner section 400 outlet face 410.

The pre-mixing flow passage inlet (404) may have a first shape on the inlet face (406) of the main burner section (400), and the pre-mixing flow passage outlet (408) may have a second shape on the outlet face (410) of the main burner section (400). The cross-sectional shape of the pre-mixing flow passage (402) may change along the length of the pre-mixing flow passage (402) from the first shape to the second shape.

The first shape may be a polygonal shape chosen from a list comprising a square, rectangle, hexagon; and the second shape may be a circle.

The pre-mixing flow passages (402) may be grouped in rows (420) which extend radially away from the centre axis (Y), with radially extending passages (416) of the manifold (412) extending between the rows (420).

The cross-sectional area of the pre-mixing flow passage inlets (404) may increase as the distance from the centre axis (Y) increases.

The fuel manifold (412) of the main burner section (400) may further comprise a manifold plenum (422) which is provided in series between the swirler section (300) fuel flow passage (304) and each of the radially extending passages (416) of the manifold (412).

The manifold plenum (422) may be divided into sub plenums by struts (440).

The main burner section (400) may further comprise a cooling plenum (430) proximate to the outlet face (410) of the main burner section (400).

The cooling plenum (430) may have an inlet (432) on an outer circumference of the main burner section (400) and an at least one outlet (434) on the outlet face (410) of the main burner section (400) between rows (420) of pre-mixing flow passage outlets (408).

The fuel injector (414) in some pre-mixing flow passages (402) may be provided a first distance X1 from the inlet face (406) of the main burner section (400); and the fuel injector (414) in other (for example, the remaining) pre-mixing flow passages (402) is provided a second distance X2, greater than the first distance X1, from the inlet face (406) of the main burner section (400).

The fuel injectors (414) in the radially inner pre-mixing flow passages (402) and radially outer pre-mixing flow passages (402) may be provided a first distance X1 from the inlet face (406) of the main burner section (400). The fuel injectors (414) in the pre-mixing flow passages (402) between the radially inner and radially outer pre-mixing flow passages (402) may be provided at the second distance X2 from the inlet face (406) of the main burner section (400).

The outlet face (410) of the main burner section (400) may extend orthogonally relative to the centre axis (Y). The outlet face (410) of the main burner section (400) may extend at an angle relative to the centre axis (Y), such that the radially outer pre-mixing flow passage outlets (408) are downstream of the radially inner pre-mixing flow passage outlets (408).

The main burner section (400) may extend axially away from the vane trailing edge (306) in the downstream direction (Y1); the pilot burner section (200) being spaced apart from the main burner section (400) to define an annular swirl flow path (320) extending therebetween from the vane trailing edge (306).

The annular swirl flow path (320) may increase in diameter with increasing distance from the vane trailing edge (306) in the downstream direction (Y1).

The distance between the main burner section (400) and pilot burner section (200) may decrease with increasing distance from the vane trailing edge (306) in the downstream direction (Y1) such that the flow area of the annular swirl flow path (320) decreases with increasing distance from the vane trailing edge (306) in the downstream direction (Y1).

The pilot burner section (200) may define an oxidant flow passage (208) that may extend from an oxidant flow passage inlet (220) on an inlet face (222) of the pilot burner section (200) to a pilot burner oxidant flow passage outlet (226) on an outlet face (224) of the pilot burner section (200); the inlet face (222) being upstream of the outlet face (224); and the outlet face (224) being downstream of the pilot burner section (200) fuel injector (206).

The pilot burner oxidant flow passage outlet (226) may comprise a plurality of apertures (228) which open onto the outlet face (224) of the pilot burner section (200); a pilot burner oxidant flow plenum (230) may be located between, and in flow communication with, the oxidant flow passage (208) and plurality of apertures (228).

A first flow guide hat (431) may extend from a radially outer surface (432) of the main burner section (400), away from the inlet face (406) of the main burner section (400) in the upstream direction (Y2); and a second flow guide hat (435) may extend from a radially inner surface (424) of the main burner section (400), away from the inlet face (406) of the main burner section (400) in the upstream direction (Y2) to thereby define a main burner section inlet flow path (436) between the first flow guide hat (431) and the second flow guide hat (435); and to thereby define a swirler section inlet flow path (336) between the second flow guide hat (435) and a radially outer surface (232) of the a pilot burner section (200).

The combustor may be an annular-type or a can-type combustor. The combustion chamber may have a cylindrical or oval shape. The combustion chamber may comprise a main combustion chamber.

Advantageously, relative to examples of the prior art, the above features of the present disclosure provide improved mixing of the oxidant/fuel mixture prior to it entering the combustion chamber, thus lowering NOx emissions, whether the fuel is hydrogen, natural gas, or a blend of both.

BRIEF DESCRIPTION OF THE DRAWINGS

Examples of the present disclosure will now be described with reference to the accompanying drawings, in which.

DETAILED DESCRIPTION

The detail presented in the figures is by way of illustration only. Similar or identical elements are provided with the same reference signs in different figures.

Figure 1:
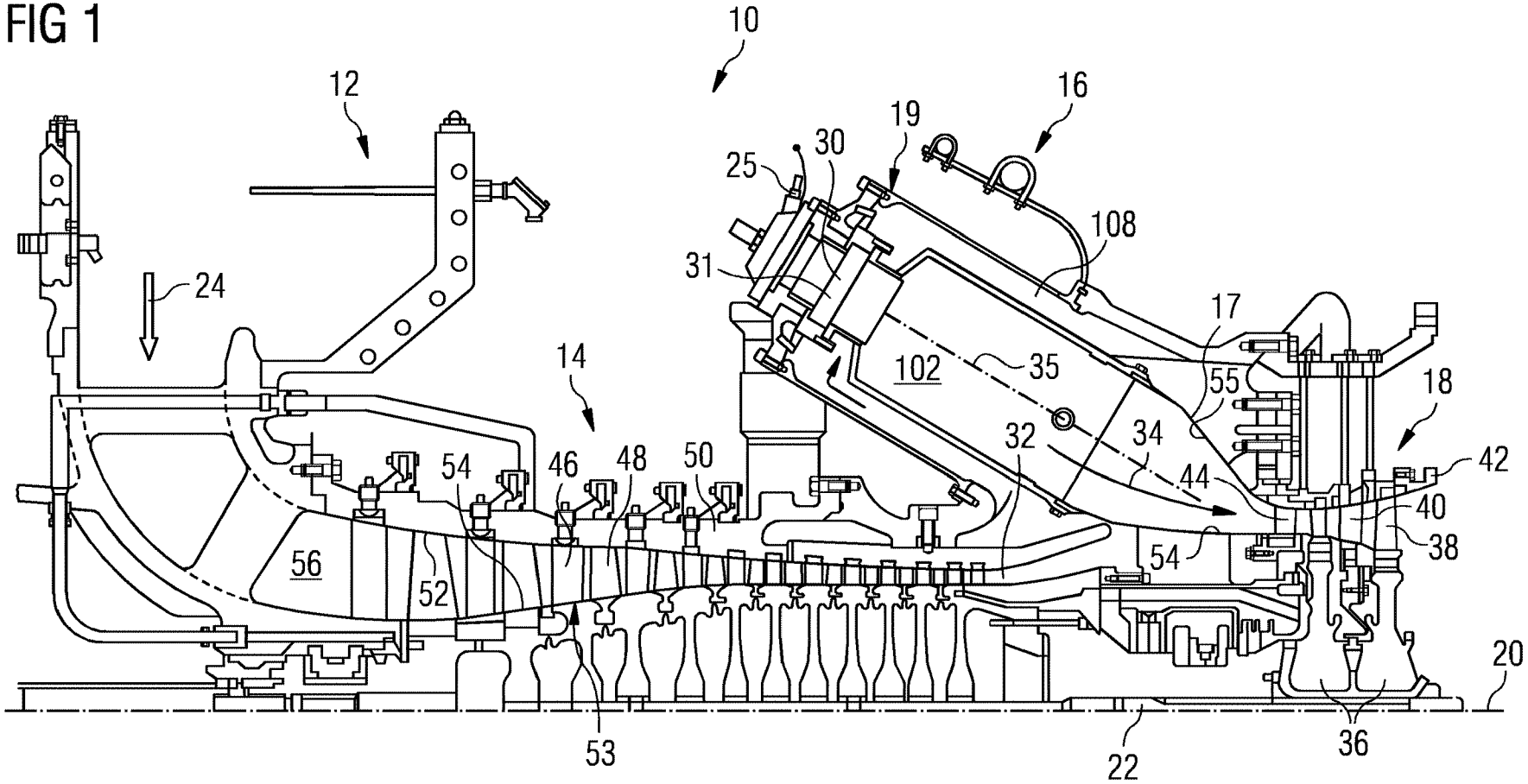
FIG. 1 shows a longitudinal sectional view of a gas turbine engine including a combustor according to the present disclosure.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12, is compressed by the compressor section 14 and delivered to the combustion section (or burner section) 16.

The burner section 16 comprises a burner plenum 108 and one or more combustion chambers 102. The burner section 16 further comprises at least one burner 30 which defines an inlet 104 to each combustion chamber 102. As described below, each burner of the inlet 104 comprises a pilot burner section 200, a swirler section 300 and a main burner section 400. The compressed air passing through the compressor 14 enters a diffuser 32 and is discharged from the diffuser 32 into the burner plenum 108 from where a portion of the air enters the pilot burner section 200, the swirler section 300 and the main burner section 400 and is mixed with a gaseous or liquid pilot fuel in the pilot burner section 200 and swirler section 300. The air/fuel mixture is then burned and the combustion gas 34 or working gas from the combustion is channelled through the combustion chamber 102 to the turbine section 18 via a transition duct 17. A main flow of air/fuel mixture is further inserted in the pilot burner section 200 through a fuel conduit 202, as better detailed in a following section of the present text. The main fuel burns after exiting the burner 30 at the inlet 104 when mixing with the hot gasses in the chamber 102.

This exemplary gas turbine engine 10 has an annular combustor section arrangement 16, which is constituted by an annular array of combustor cans 19 each having a burner 30 and a combustion chamber 102, the transition duct 17 having a generally circular inlet that interfaces with the combustion chamber 102 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 102 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present disclosure is described with reference to the above exemplary turbine engine having a single shaft or spool connecting a single, multi-stage compressor and a single, one or more stage turbine. However, it should be appreciated that the present disclosure is equally applicable to two- or three-shaft engines and which can be used for industrial, aero or marine applications.

The terms upstream and downstream refer to the flow direction of the airflow and/or working gas flow through the engine unless otherwise stated. When not differently specified, the terms axial, radial and circumferential are made with reference to the rotational axis 20 of the engine.

Figure 2:
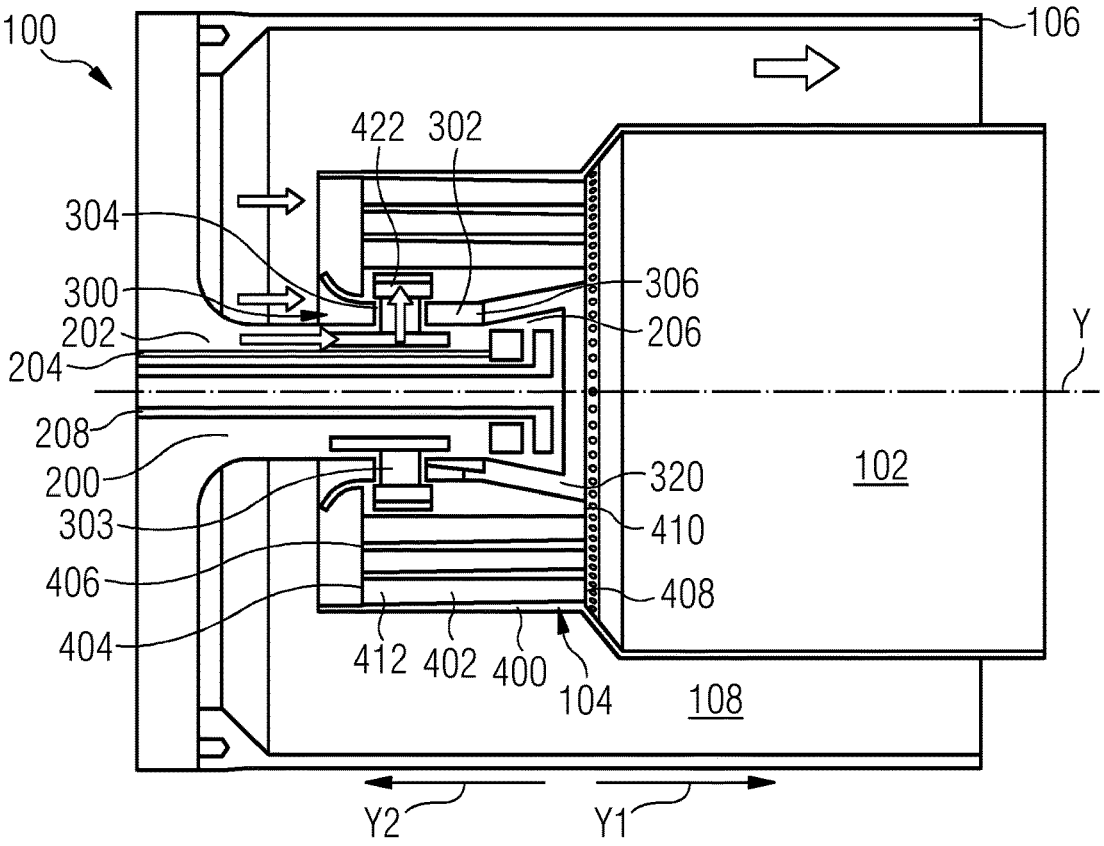
FIG. 2 shows a partial longitudinal section of a combustor for a gas turbine according to the present disclosure.
Figure 3:
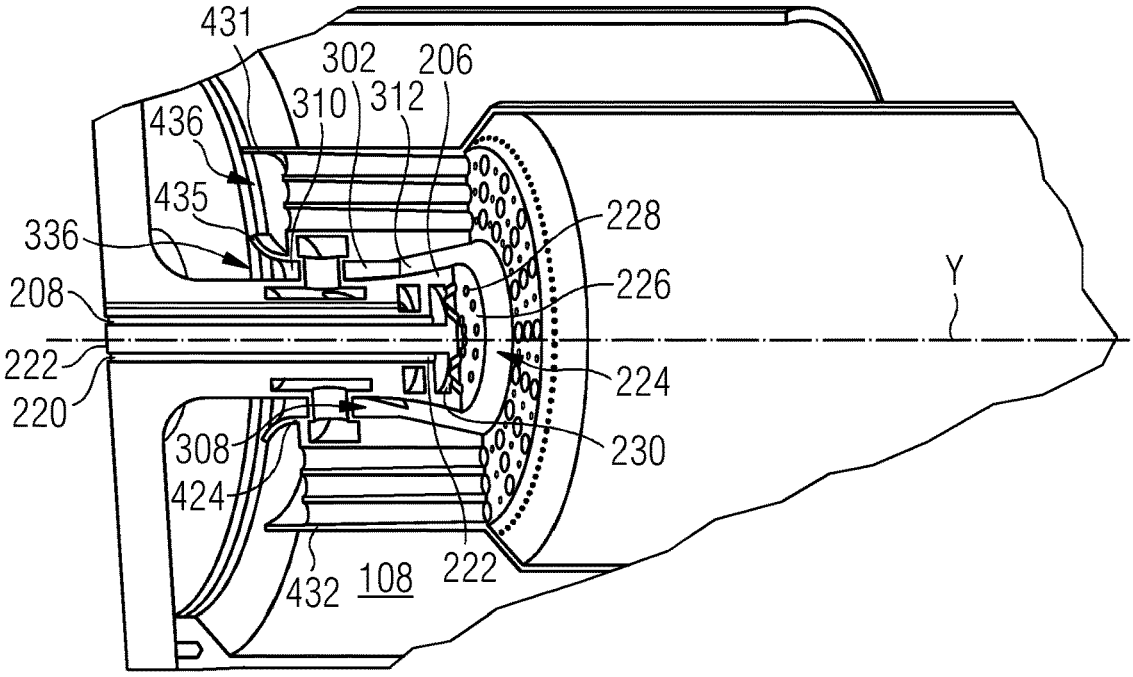
FIG. 3 shows a partial longitudinal isometric sectional view of the combustor shown in FIG. 2.

FIGS. 2, 3 shows a combustor 100 for a gas turbine, suitable for use in the gas turbine of FIG. 1. The combustor 100 extends along a centre axis Y and comprises a combustion chamber 102 having an inlet 104. There is also provided a combustor housing 106 which bounds (i.e. surrounds), and is spaced apart from, the combustion chamber 102, to define a burner plenum 108 therebetween which, in use, an oxidant gas (e.g. air) flows as indicated by the arrows in FIGS. 2, 3. The combustion chamber 102 per se and housing 106 may be conventional and therefore not described in further detail.

The combustion chamber inlet 104 is defined by (i.e. comprises) the burner 30, which comprises the pilot burner section 200, the swirler section 300 and the main burner section 400. The pilot burner section 200, swirler section 300 and main burner section 400 are concentric and/or co-axial, and each centred on the centre axis Y.

The pilot burner section 200 is centred on the centre axis Y. The pilot burner section 200 defines a fuel delivery conduit 202 having an inlet 204 for fluid communication with a fuel source, for example the fuel supply for the engine comprising hydrogen, natural gas or a blend of both. The pilot burner section 200 further comprises a fuel injector 206 in fluid communication with the fuel delivery conduit 202.

The swirler section 300 comprises vanes 302 which extend radially outwards from the pilot burner section 200.

Each vane 302 has a leading edge 303 and a trailing edge 306. In the context of the apparatus of this disclosure, and as illustrated in FIG. 2, a downstream direction Y1 is defined by the direction from the vane leading edge 303 to the vane trailing edge 306 along the centre axis Y, and an upstream direction Y2 is defined by the direction from the vane trailing edge 306 to vane leading edge 303 along the centre axis Y.

The vanes 302 are spaced apart from one another around the outer circumference of the pilot burner section 200 to define oxidant flow passages 308. Each oxidant flow passage 308 has a flow inlet 310 at the vane leading edge 303 and a flow outlet 312 at the vane trailing edge 306. The vanes 302 are configured (i.e. sized, angled, shaped and/or spaced apart) to impart swirl to fluid (e.g. air) passing through the swirler section 300. Hence flow exiting the flow outlets 312 will (to some extent) be induced to have a circumferential component around the centre axis Y.

As illustrated in FIGS. 2, 3 the main burner section 400 may extend axially away from the vane trailing edge 306 in the downstream direction Y1. The pilot burner section 200 is spaced apart from the main burner section 400 to define an annular swirl flow path 320 extending therebetween from the vane trailing edge 306.

Figure 6:
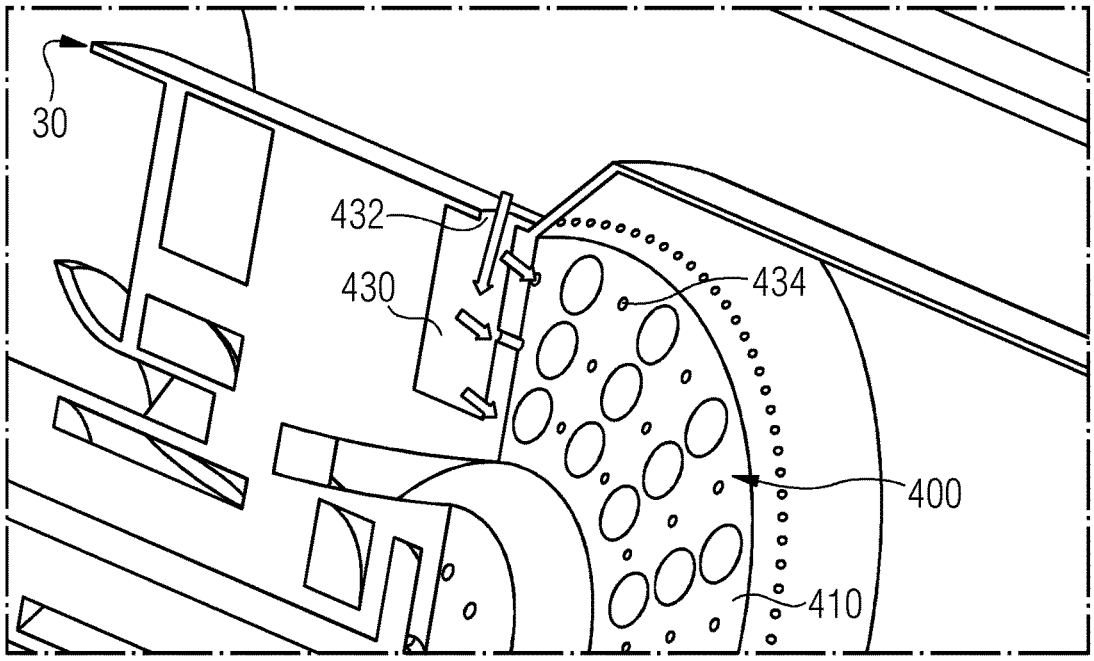
FIG. 6 shows the view of FIG. 4 from a different angle.

The annular swirl flow path 320 increases in diameter with increasing distance from the vane trailing edge 306 in the downstream direction Y1. Hence, for example as shown in FIG. 6, the wall thickness of the main burner 400, on its inner circumference, decreases with increasing distance from the vane trailing edge 306 in the downstream direction Y1. Hence the outer surface of the pilot burner section 200 increases in diameter with increasing distance from the vane trailing edge 306 in the downstream direction Y1, and the inner circumference of the main burner section 400 increases with increasing distance from the vane trailing edge 306 in the downstream direction Y1. Put another way, the outer surface of the pilot burner section 200 and the inner circumference of the main burner section 400 flare radially outwards with increasing distance from the vane trailing edge 306 in the downstream direction Y1. This arrangement allows for cooling of the main burner by the flow travelling along the annular flow path 320, especially towards, and at, the region of an outlet face 410 of the main burner section 400.

The distance between the main burner section 400 and pilot burner section 200 decreases with increasing distance from the vane trailing edge 306 in the downstream direction Y1 such that the flow area of the annular swirl flow path 320 decreases with increasing distance from the vane trailing edge 306 in the downstream direction Y1. This decreases the pressure of the fluid passing along the swirl flow path 320, continually accelerating the flow, and thus the velocity at exit from the flow path 320, and thus reduces risk of flashback into the flow path 320.

The pilot burner section 200 extends axially away from the vane leading edge 303 in the upstream direction Y2 and extends axially away from the vane trailing edge 306 in the downstream direction Y1.

The pilot burner section 200 fuel injector 206 is located downstream of the vane trailing edge 306, on the outer surface of the pilot burner section 200, in the annular swirl flow path 320. Hence flow exiting the flow outlets 312 will pass over the exit from the pilot burner section 200 fuel injector 206, causing the fuel exiting the injector to mix with the air. A plurality of pilot burner section 200 fuel injectors 206 may be provided around the circumference of the pilot burner section 200, each operable to inject fuel into the turbulent flow exiting the flow passage outlets 312.

The fuel injector 206 in this location reduces the time for pre-mixing before entering the combustion chamber 102 (i.e. the combustion zone), and hence there will be pockets of the fuel/air mix that will have a higher fuel:air ratio than others in the combustion chamber 102 (i.e. in the combustion zone). Hence these will "burn rich", which provides for a stable pilot flame during engine start-up, acceleration and low load turbine load operation.

The main burner section 400 extends radially outwards from, and surrounds (i.e. bounds) the swirler section 300.

As shown in FIGS. 2, 3, 4, 5, 7, 9, 10 the main burner section 400 defines a plurality of pre-mixing flow passages 402 which each extend from a pre-mixing flow passage inlet 404 on an inlet face 406 of the main burner section 400 to a pre-mixing flow passage outlet 408 on an outlet face 410 of the main burner section 400.

Hence, as shown in FIGS. 2, 3, the combustion chamber 102 (and hence the combustion zone) may be defined upstream by the outlet face 410 of the main burner section 400. Hence fuel/air is directly injected into the combustion chamber 102. Thus the main burner section 400 outlet face 410 defines (i.e. provides) at least part of the limit/boundary of the combustion zone of the combustion chamber 102. With this arrangement, combustion does not occur upstream of the main burner section 400 outlet face 410, and only occurs downstream of the main burner section 400 outlet face 410.

Figure 8:
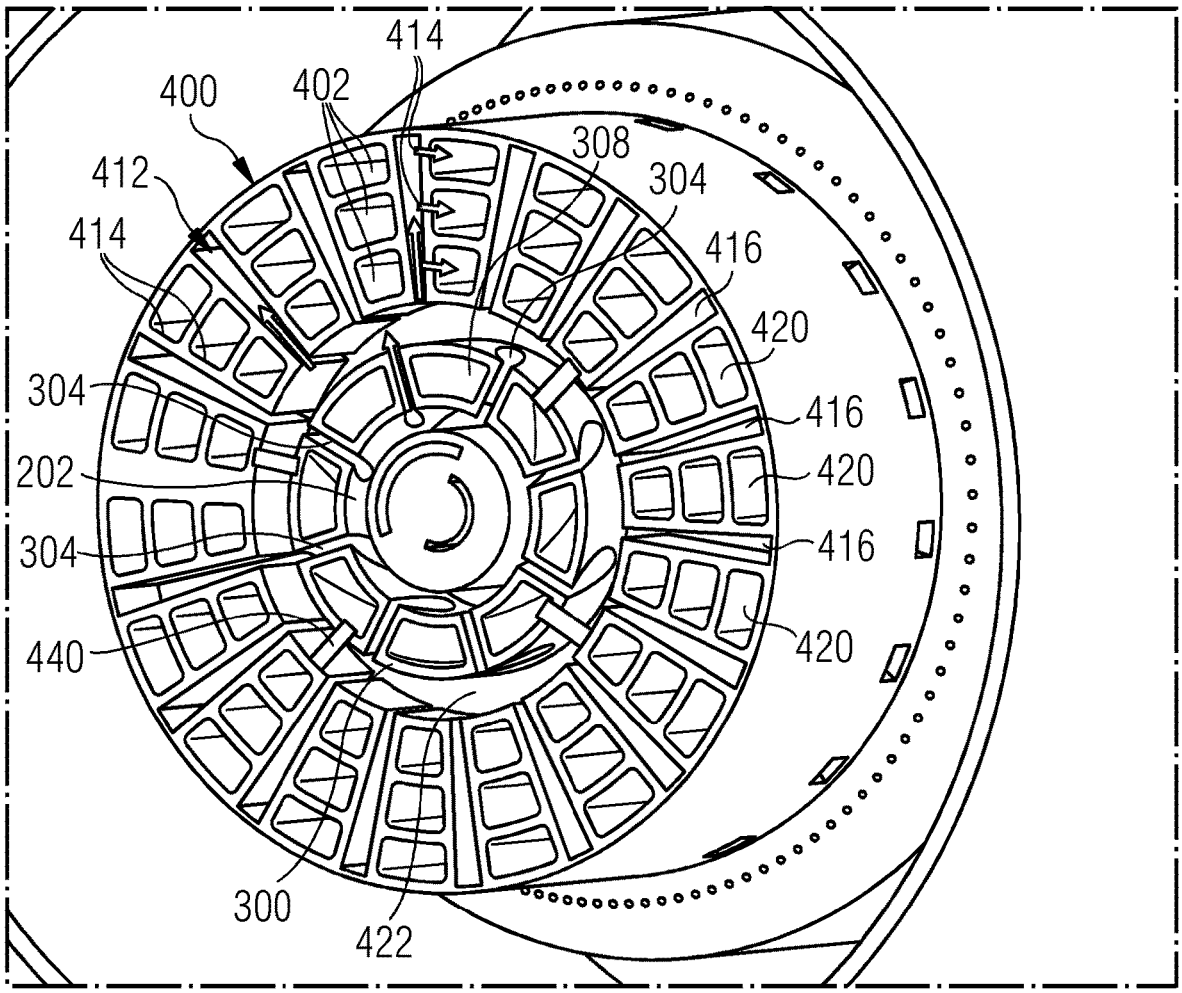
FIG. 8 shows an isometric sectional view of the combustor burner, shown in FIGS. 2, 3.

As shown in the view of FIG. 8, which is a sectional view through the burner 30, the main burner section 400 further comprises (i.e. defines) a fuel manifold 412, each of the pre-mixing flow passages 402 being provided with a fuel injector 414 in flow communication with the fuel manifold 412.

The fuel manifold 412 is in communication with the fuel delivery conduit 202 in the pilot burner section 200 via a fuel flow passage 304 which extends through the swirler section 300.

The pre-mixing flow passage inlet 404 has a first shape on the inlet face 406 of the main burner section 400, and the pre-mixing flow passage outlet 408 has a second shape on the outlet face 410 of the main burner section 400. The cross-sectional shape of the pre-mixing flow passage 402 changes along the length of the pre-mixing flow passage 402 from the first shape to the second shape.

The first shape may be a polygonal shape chosen from a list comprising a square, rectangle, hexagon, albeit with rounded corners, and the second shape may be a circle.

The shape change along the length of the pre-mixing flow passage 402 will generate turbulence for better fuel and air mixing, which will result in lower NOx formation. The gradual transition to circular shape will reduce risk of flashback.

A circular outlet 408 is preferable as it forms a flow jet with a desirable flow pattern for combustion. However, having a polygonal shape at inlet 404 means that the inlet size can be optimised for the amount of space available on the inlet face 406, as polygons, and especially squares and rectangular inlets can be arranged with a minimum area of the burner face 406 obstructing the flow of oxidant.

The cross-sectional area of each pre-mixing flow passage inlet 404 may reduce along its length from the inlet face 406 to the outlet face 410. The cross-sectional area of each pre-mixing flow passage inlet 404 may reduce along its length from the inlet face 406 to the outlet face 410 by no more than 30%. The cross-sectional area of each pre-mixing flow passage inlet 404 may reduce along its length from the inlet face 406 to the outlet face 410 by at least 5% but no more than 20%. This slight reduction in area enhances pre-mixing. The reduction in area also increases flow velocity of the jet leaving the outlet 408. This promotes the formation of a jet, which is important to reduce flashback, especially for fuels containing a large amount of hydrogen.

This arrangement also results in less variation of fuel:air ratio between the pre-mixing flow passages 402. Hence this will also reduce variation in equivalence ratio between the pre-mixing flow passages 402. Equivalence ratio is defined as the ratio of the actual fuel:air ratio to the stoichiometric fuel:air ratio.

Figure 4:
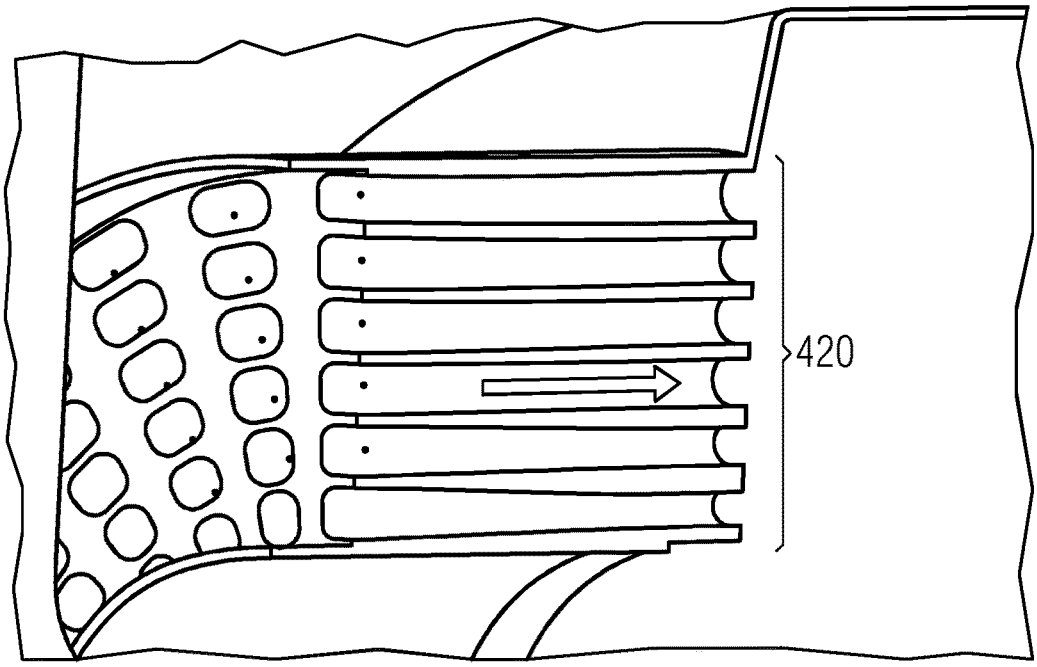
FIG. 4 shows an enlarged view of a section of the combustor burner shown in FIGS. 2, 3.
Figure 5:
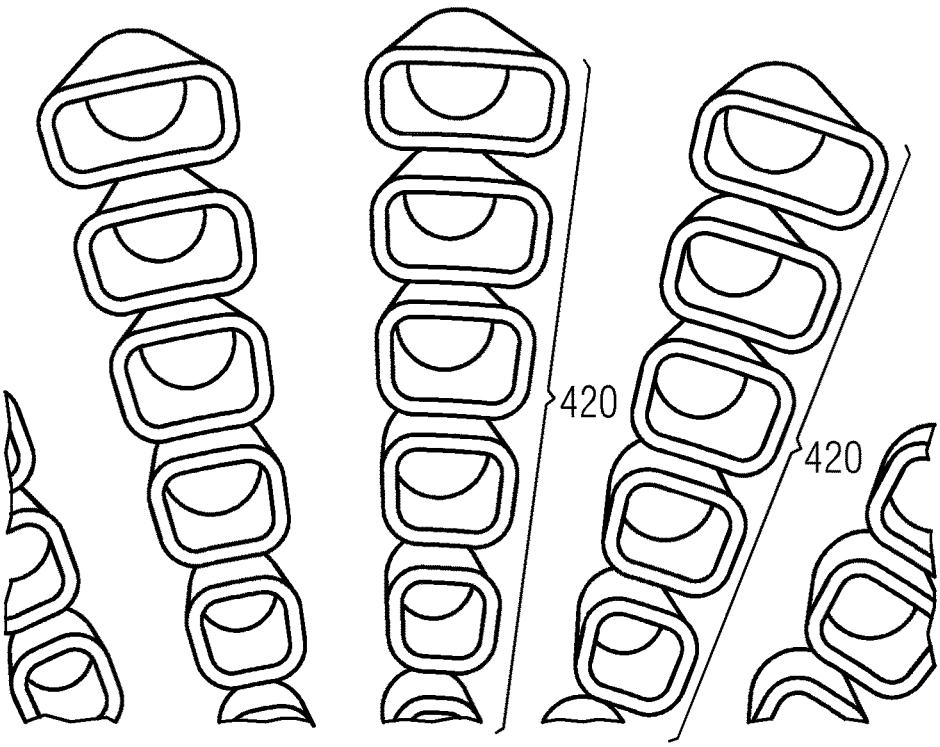
FIG. 5 shows a representation of flow passages shown in FIGS. 2, 3, 4.

As illustrated in FIGS. 4, 5, 6, 8, 9, 10, the pre-mixing flow passages 402 may be grouped in rows 420 which extend radially away from the centre axis Y, with radially extending passages 416 of the manifold 412 extending between the rows 420. The example in FIG. 8 shows three pre-mixing flow passages 402 in each radially extending row. The examples in FIGS. 4, 5 show six pre-mixing flow passages 402 in each radially extending row. In other examples there may be a single ring of pre-mixing flow passages 402. In further examples there may be two or more pre-mixing flow passages 402 in each radially extending row 420.

As illustrated in FIGS. 5, 8, the cross-sectional area of the pre-mixing flow passage inlets 404 increases as the distance from the centre axis Y increases. As best illustrated in FIG. 5, the cross-sectional shape of the pre-mixing flow passage inlets 404 may change as the distance from the centre axis Y increases, for example being a square at the radially inner section of the row 420, transforming to a rectangle as the distance from the centre axis Y increases in a radially outer direction.

As shown in FIG. 8 the fuel manifold 412 of the main burner section 400 may further comprise a manifold plenum 422 which is provided in series between the swirler section 300 flow passage 304 and each of the radially extending passages 416 of the manifold 412.

The manifold plenum 422 is divided into sub plenums by struts 440. This may be provided to stage the fuel in circumferential direction by partitioning of the fuel into four to six different zones. The number of vanes needs to alter accordingly. For example, for four zones, eight vanes could be used such that every 90 deg angle accommodates two vanes and a sector of tubes consist of 90 deg.

As illustrated in FIG. 6, the main burner section 400 may further comprise a cooling plenum 430 proximate to the outlet face 410 of the main burner section 400. The cooling plenum 430 may have an inlet 432 on an outer circumference of the main burner section 400 and an at least one outlet 434 on the outlet face 410 of the main burner section 400 between rows 420 of pre-mixing flow passage outlets 408. There may be provided a plurality of inlets 432, plenums 430 and outlets 434, for example one between each pair of rows 420 of pre-mixing flow passages 402.

Figure 7:
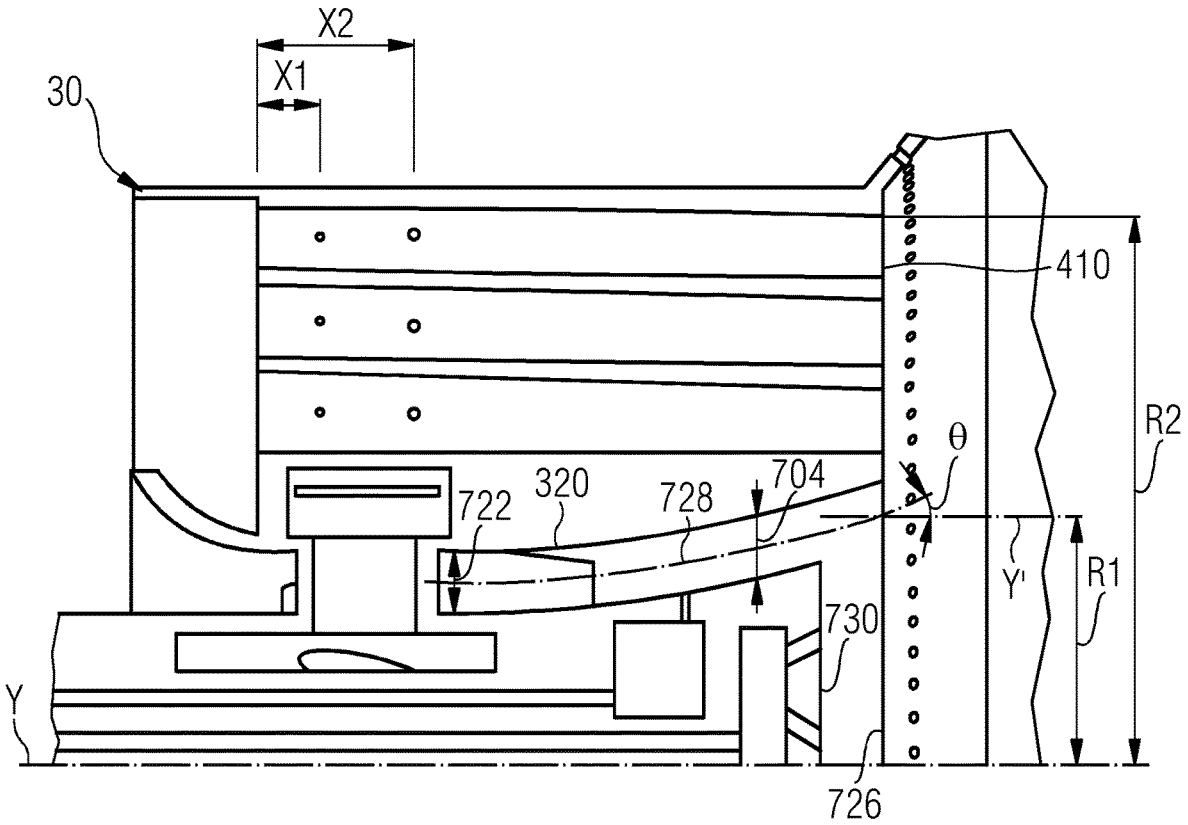
FIG. 7 shows an enlarged view of a section of the combustor burner shown in FIGS. 2, 3.

As illustrated in FIG. 7, the fuel injector 414 in some pre-mixing flow passages 402 may be provided a first distance X1 from the inlet face 406 of the main burner section 400, and the fuel injector 414 in some pre-mixing flow passages 402 may be provided a second distance X2, from the inlet face 406 of the main burner section 400, the second distance X2 being greater than the first distance X1.

In one example, not shown, the fuel injectors 414 in the radially inner pre-mixing flow passages 402 and radially outer pre-mixing flow passages 402 are provided a first distance X1 from the inlet face 406 of the main burner section 400, and the fuel injectors 414 in the pre-mixing flow passages 402 between the radially inner and radially outer pre-mixing flow passages 402 are provided at the second distance X2 from the inlet face 406 of the main burner section 400.

X1 may be in the range of 5% to 30% of the length the pre-mixing flow passage 402, and X2 may be in the range of 15% to 50% of the length the pre-mixing flow passage 402.

In examples in which the location of the fuel injectors 414 is different in some of the pre-mixing flow passages 402, the amount of pre-mixing will be varied also. Hence where the fuel injector 414 is closer to the inlet face 406 there will be more pre-mixing than where the fuel injectors are closer to the outlet face 410. This may improve combustion dynamics, since there will be a gradient of fuel:air ratio at exit from the main burner 400.

FIG. 7 shows details of an example of the annular swirl flow path 320. The annular swirl flow path 320 is divergent between an upstream plane 722 and an exit plane 726 and in the direction from the upstream plane 722 and the exit plane 726 or in a downstream direction relative to the flow therethrough. The exit plane 722 may be the defined by the outlet face 410. The annular swirl flow path 320 has a mid-path line 728. At the exit plane 722 the mid-path line 728 has an angle θ to the centre axis Y of the combustor 100. A line Y' is shown and is parallel to the centre axis Y. The angle θ may be 25° and ≤45°. A preferred angle θ may lie between ≥10° and ≤25°. The diverging annular swirl flow path 320 causes the fuel/air mixture to form a recirculation region located immediately about the centre axis Y. The recirculation region increases residence time enhancing complete combustion of the fuel air mixture.

The diverging annular swirl flow path 320 creates a central area 730 of the outlet face 410 than would be the case if the annular swirl flow path 320 was not divergent. The increased central area 730 of the outlet face 410 provides a much larger flame holding surface and thereby improves flame stabilization. The central area 730 has a radius R1 and the outlet face has a radius R2. R1 is preferably 50% of R2 but may be between and including 25% and 75% of R2. Preferably R1 may be between and including 40% and 50% of R2. Thus, the relative dimension or radius of the central area 730 to the outlet face 410 provides a suitable size central area to allow flame holding characteristics. A portion of this swirl flow is mixed with the fuel and air from the main burner section 400 downstream of face 410. The fuel air mixture strength in flow path 320 may be easily controlled by changes to the fuel flow quantity and which allows control of the burning zones to reduce emissions and particularly to minimise Nitrogen Oxides as well as Carbon Monoxides across the gas turbine load range.

A cross-sectional area of the exit plane 726 is the same as a cross-sectional area of the upstream plane 722. Thus, the annular swirl flow path 320, when viewed in FIG. 7, decreases in its radial dimension between and in the direction from the upstream plane 722 and the upstream plane 722. In one example, the cross-sectional area of the exit plane 726 is up to and including 10% less than the cross-sectional area of the upstream plane 722. Thus, the fuel and air mixture travelling through the annular swirl flow path 320 is accelerate by virtue of the reducing cross-sectional area of the annular swirl flow path 320. Thus, the reducing cross-sectional area of the annular swirl flow path 320 provides resistance to potential flashback when high reactivity fuels, such as fuels containing ≥5% Hydrogen or high-Hydrocarbons, are used.

As illustrated in FIGS. 2, 3 an outlet face 410 of the main burner section 400 may extend orthogonally relative to the centre axis Y. In the alternative example of FIGS. 9, 10 the outlet face 410 of the main burner section 400 extends at an angle A degrees relative to the centre axis Y of the combustor 100, such that the radially outer pre-mixing flow passage outlets 408 are downstream of the radially inner pre-mixing flow passage outlets 408.

Figure 9:
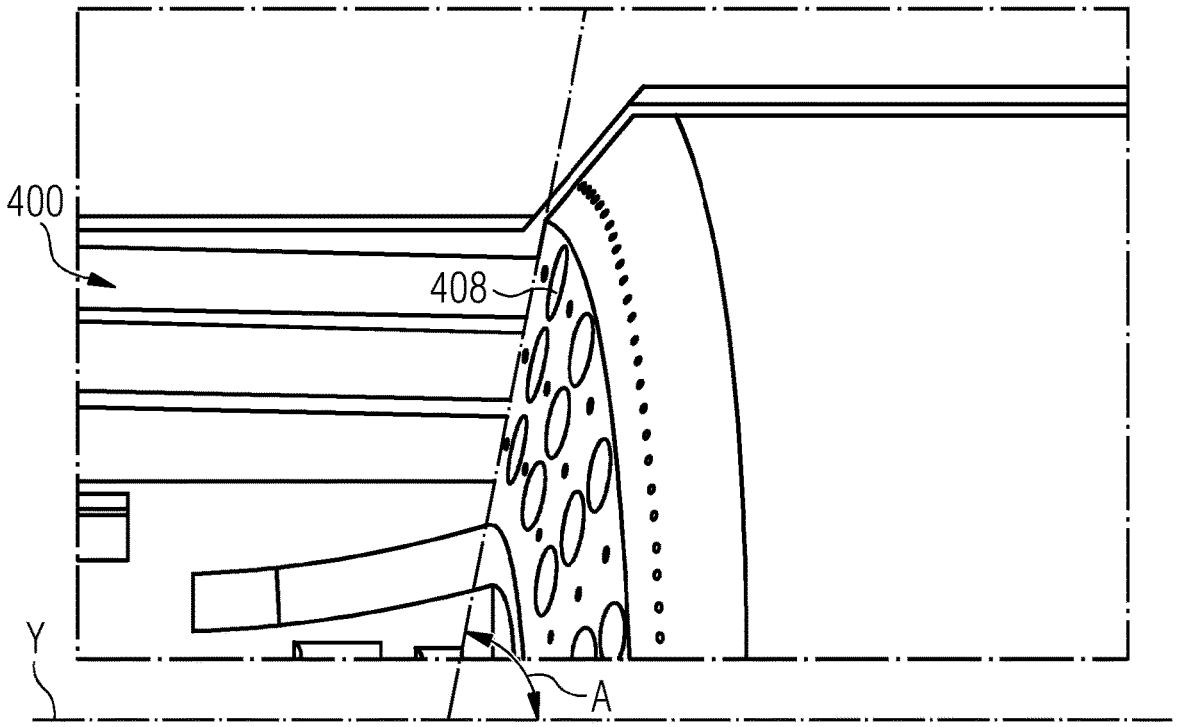
FIGS. 9, 10 show a further example of a region of the combustor burner, akin to the view of FIG. 7.
Figure 10:
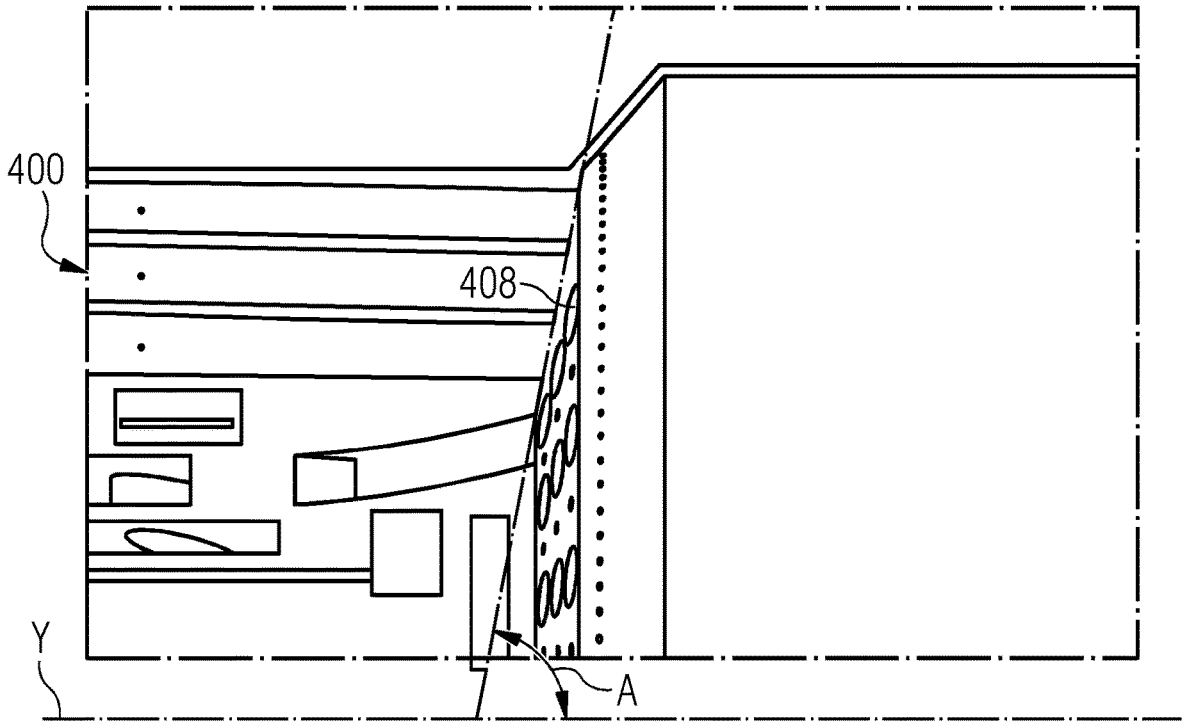

Hence, in some examples, and as illustrated in FIGS. 2, 3, angle A may be 90 deg to the combustor axis Y. In other examples, for example as shown in FIGS. 9, 10, angle A may be less than 90 deg but greater than, or equal to, 60 deg to the combustor axis Y. For example angle A may be about 60 deg to the combustor axis Y. With angle A in this range (i.e. less than 90 degrees, and at least 60 degrees), this may promote higher or lower interaction of gases leaving the pilot 200 and main section 400 of the burner 30. In an example in which richer mixtures and/or combustion hot products from the pilot 200 mixes with flow from the main section 400, it may result in higher/greater flame stability and/or enhanced blow off limits of the main section 400. Put another way, the examples of FIGS. 9, 10 may reduce emissions and/or improve combustion dynamics compared to examples of the related art.

As shown in FIGS. 2, 3 the pilot burner section 200 defines an oxidant flow passage 208 which extends from an oxidant flow passage inlet 220 on an inlet face 222 of the pilot burner section 200 to a pilot burner oxidant flow passage outlet 226 on an outlet face 224 of the pilot burner section 200. The inlet face 222 is upstream of the outlet face 224. The outlet face 224 is downstream of the pilot burner section 200 fuel injector 206. The outlet face 224 may extend orthogonally relative to the centre axis Y.

The pilot burner oxidant flow passage outlet 226 may comprises a plurality of apertures 228 which open onto the outlet face 224 of the pilot burner section 200. A pilot burner oxidant flow plenum 230 may be located between, and in flow communication with, the oxidant flow passage 208 and plurality of apertures 228.

A first flow guide hat 431 may extends from a radially outer surface 432 of the main burner section 400, away from the inlet face 406 of the main burner section 400 in the upstream direction Y2. A second flow guide hat 435 may extends from a radially inner surface 424 of the main burner section 400, away from the inlet face 406 of the main burner section 400 in the upstream direction Y2 to thereby define a main burner section inlet flow path 436 between the first flow guide hat 431 and the second flow guide hat 435 and to thereby define a swirler section inlet flow path 336 between the second flow guide hat 435 and a radially outer surface 232 of the pilot burner section 200. The second flow guide hat 4345, as shown in FIGS. 2, 3, 6, 7 may flare out in a radial direction, away from the inlet face 406 of the main burner section 400 in the upstream direction Y2, to form a funnel-type arrangement for directing flow onto the vanes 302.

The combination of flow guide hats 431, 435 will result in more uniform air distribution entering each pre-mixing flow passage 402, so that the fuel:air ratio of the flow exiting the main burner 400 has a uniform and predictable pattern.

The apparatus of the present disclosure, providing a central swirl stabilized pilot with larger flame holder face, will improve turbine operation during start-up, acceleration and at lower load compared to arrangements of the related art. The swirl stabilized pilot will also enable the engine to be responsive to changing load demands.

The nested (i.e. concentric) arrangement of the main burner section 400, swirler section 300 and pilot burner 200 provide, in operation, a distributed flame with multiple shear zones in the radial direction. This configuration provides improved mixing of the oxidant/fuel mixture prior to it entering the combustion chamber, hence reducing localized peak temperatures, and thus lowering NOx emissions, whether the fuel is hydrogen, natural gas, or a blend of both.

The nested (i.e. concentric) arrangement also ensure the majority of combustion occurs proximate to the inlet 104 of the combustor 100, and hence reduces the volume of carbon monoxide produced relative to examples of the related art in conditions where natural gas makes up a component of the fuel.

During operation the burner 30, which defines the inlet 104, will be heated by the combustion event. Flow through the pre-mixing flow passages 402 will extract heat from the burner, and since all of the fuel and air passing through the pre-mixing flow passages 402 will be heated to a similar extent, the combustion characteristic of the fuel/air mix induced by the heating will be substantially uniform.

During operation, with this arrangement of pilot burner 200 and main burner 400, heat release from the combustion will be more uniform in the direction normal to the Y axis (i.e. the radially outward from the Y axis) compared to a traditional swirl stabilized burner. Consequently, the temperate profile at inlet to the turbine will be more uniform than with burners of the related art, which results in increased the life of the turbine section.

In particular the distributed fuel-air arrangement, with a higher number of fuel injection points and increased pre-mixing, provides for low NOx emissions.

The configuration of the apparatus of the present disclosure also provides higher flashback resistance without any restriction being required in the pre-mixing flow passages 402, which thus allows for higher mass flow rate through the pre-mixing flow passages 402.

The configuration of the present disclosure is also advantageous as it is easy to scale by changing the number of pre-mixing flow passages 402 and the diameter of the burner sections while keeping a similar structure.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A combustor for a gas turbine, the combustor extending along a centre axis (Y) and comprising a combustion chamber having an inlet; the combustion chamber inlet defined by a burner comprising:

a pilot burner section centred on the centre axis (Y) and which defines a fuel delivery conduit having an inlet for fluid communication with a fuel source; and a fuel injector in fluid communication with the fuel delivery conduit;

a swirler section comprising vanes which extend radially outwards from the pilot burner section;

a main burner section which extends radially outwards from, and surrounds, the swirler section;

the pilot burner section is spaced apart from the main burner section to define an annular swirl flow path extending therebetween, the annular swirl flow path comprises an upstream plane and an exit plane;

the main burner section defining a plurality of pre-mixing flow passages which each extend from a pre-mixing flow passage inlet on an inlet face of the main burner section to a premixing flow passage outlet on an outlet face of the main burner section;

the main burner section further comprising a fuel manifold, each of the pre-mixing flow passages being provided with a fuel injector in flow communication with the fuel manifold; the fuel manifold being in flow communication with the fuel delivery conduit in the pilot burner section via a fuel flow passage which extends through the swirler section;

wherein the pre-mixing flow passages are grouped in rows which extend radially away from the centre axis (Y), with radially extending passages of the manifold extending between the rows, wherein fuel injectors of a first subset of the premixing flow passages are located at a first distance XI from the inlet face of the main burner section, and fuel injectors of a second subset of the pre-mixing flow passages are located at a second distance X2, greater than the first distance XI, from the inlet face of the main burner section, wherein the fuel injectors in radially inner pre-mixing flow passages are located at the first distance XI from the inlet face of the main burner section, wherein the fuel injectors in radially outer pre-mixing flow passages are provided the first distance XI from the inlet face of the main burner section;

and wherein the fuel injectors in the pre-mixing flow passages between the radially inner pre-mixing flow passages and the radially outer pre-mixing flow passages are located at the second distance X2 from the inlet face of the main burner section.

2. A combustor as claimed in claim 1, wherein the annular swirl flow path is divergent between the upstream plane and the exit plane and in the direction from the upstream plane towards the exit plane.

3. A combustor as claimed in claim 2, wherein the annular swirl flow path has a mid-path line, at the exit plane the mid-path line has an angle θ to the centre axis (Y) of the combustor, the angle θ in a range from one of the following: i) the angle θ is >5° and <45°, ii) the angle θ is between >10° and <25°.

4. A combustor as claimed in claim 3, wherein the outlet face of the main burner section faces downstream or towards the combustion chamber, and wherein the outlet face of the main burner section comprises a central area defined as a radially inward area of the outlet face of the main burner section from the mid-path line at the exit plane, the central area has a radius R1 and the outlet face has a radius R2, radius R1 is in a range from one of the following: i) radius R1 is between and including 25% and 75% of radius R2, ii) radius R1 is between and including 40% and 50% of radius R2, iii) radius R1 is 50% of radius R2.

5. A combustor as claimed in claim 2, wherein the main burner section extends axially away from a vane trailing edge of the vanes of the swirler section in a downstream direction (Y1); the pilot burner section being spaced apart from the main burner section to define the annular swirl flow path extending therebetween from the vane trailing edge of the vanes of the swirler section.

6. A combustor as claimed in claim 1, wherein a cross-sectional area of the exit plane is the same as or smaller than a cross-sectional area of the upstream plane of the annular swirl flow path, wherein the cross-sectional area of the exit plane is up to and including 10% less than the cross-sectional area of the upstream plane.

7. A combustor as claimed in claim 1, wherein each vane has a leading edge and a trailing edge; a downstream direction (Y1) being defined by the direction from the vane leading edge to the vane trailing edge along the centre axis (Y); and an upstream direction (Y2) defined by the direction from the vane trailing edge to the vane leading edge along the centre axis (Y); the vanes being spaced apart from one another around an outer circumference of the pilot burner section to define oxidant flow passages, each of the oxidant flow passages having a flow inlet at the vane leading edge and a flow outlet at the vane trailing edge; the pilot burner section extending axially away from the vane leading edge in the upstream direction (Y2) and extending axially away from the vane trailing edge in the downstream direction (Y1); and the fuel injector of the pilot burner section being located downstream of the vane trailing edge.

8. A combustor as claimed in claim 7, wherein a first flow guide that extends from a radially outer surface of the main burner section, away from the inlet face of the main burner section in the upstream direction (Y2), and a second flow guide that extends from a radially inner surface of the main burner section, away from the inlet face of the main burner section in the upstream direction (Y2), thereby defining a main burner section inlet flow path between the first flow guide and the second flow guide, and further defining a swirler section inlet flow path between the second flow guide and a radially outer surface of the pilot burner section.

9. A combustor as claimed in claim 1, wherein the premixing flow passage inlet has a first shape on the inlet face of the main burner section, and the pre-mixing flow passage outlet has a second shape on the outlet face of the main burner section; and the cross-sectional shape of the pre-mixing flow passage changes along the length of the premixing flow passage from the first shape to the second shape, wherein the first shape is in particular a polygonal shape chosen from a list comprising a square, rectangle, hexagon; and the second shape is a circle.

10. A combustor as claimed in claim 9, wherein the cross-sectional area of the pre-mixing flow passage inlets increases as the distance from the centre axis (Y) increases.

11. A combustor as claimed in claim 10, wherein the fuel manifold of the main burner section further comprises a manifold plenum which is in series between the swirler section flow passage and each of the radially extending passages of the manifold and/or wherein the main burner section further comprises a cooling plenum proximate to the outlet face of the main burner section; the cooling plenum having an inlet on an outer circumference of the main burner section and an at least one outlet on the outlet face of the main burner section between rows of pre-mixing flow passage outlets.

12. A combustor as claimed in claim 11, wherein the outlet face of the main burner section extends orthogonally relative to the centre axis (Y); or the outlet face of the main burner section extends at an angle relative to the centre axis (Y), such that the radially outer pre-mixing flow passage outlets are downstream of the radially inner pre-mixing flow passage outlets.

13. A combustor as claimed in claim 1, wherein the annular swirl flow path increases in diameter with increasing distance from a vane trailing edge of the vanes of the swirler section in a downstream direction (Y1) and/or wherein the distance between the main burner section and pilot burner section decreases with increasing distance from the vane trailing edge of the vanes of the swirler section in the downstream direction (Y1) such that the flow area of the annular swirl flow path decreases with increasing distance from the vane trailing edge of the vanes of the swirler section in the downstream direction (Y1).

14. A combustor as claimed in claim 1, wherein the pilot burner section defines an oxidant flow passage which extends from an oxidant flow passage inlet on an inlet face of the pilot burner section to a pilot burner oxidant flow passage outlet on an outlet face of the pilot burner section; the inlet face of the pilot burner section being upstream of the outlet face of the pilot burner section; and the outlet face of the pilot burner section being downstream of the pilot burner section fuel injector, wherein the pilot burner oxidant flow passage outlet comprises a plurality of apertures which open onto the outlet face of the pilot burner section; a pilot burner oxidant flow plenum located between, and in flow communication with, the oxidant flow passage and the plurality of apertures.

* * * * *